US009387362B2

(12) United States Patent
Dallstream

(10) Patent No.: US 9,387,362 B2
(45) Date of Patent: Jul. 12, 2016

(54) MULTIFUNCTIONAL EXERCISE APPARATUS

(71) Applicant: Mark Andrew Dallstream, Placentia, CA (US)

(72) Inventor: Mark Andrew Dallstream, Placentia, CA (US)

( * ) Notice: Subject to any disclaimer, the term of this patent is extended or adjusted under 35 U.S.C. 154(b) by 0 days.

(21) Appl. No.: 13/791,859

(22) Filed: Mar. 8, 2013

(65) Prior Publication Data

US 2013/0237388 A1 Sep. 12, 2013

Related U.S. Application Data

(60) Provisional application No. 61/608,633, filed on Mar. 8, 2012.

(51) Int. Cl.

| | |
|---|---|
| ***A63B 21/06*** | (2006.01) |
| ***A63B 21/012*** | (2006.01) |
| ***A63B 26/00*** | (2006.01) |
| ***A63B 23/02*** | (2006.01) |
| ***A63B 23/04*** | (2006.01) |

(Continued)

(52) U.S. Cl.

CPC ..... *A63B 26/00* (2013.01); *A63B 21/0609* (2013.01); *A63B 21/072* (2013.01); *A63B 21/4007* (2015.10); *A63B 21/4035* (2015.10); *A63B 23/0211* (2013.01); *A63B 23/047* (2013.01); *A63B 2069/0062* (2013.01)

(58) Field of Classification Search

CPC .. A63B 21/00; A63B 21/0004; A63B 21/012; A63B 22/00; A63B 26/00; A63B 23/047; A63B 21/04–21/0455; A63B 21/05–21/0557; A63B 21/06–21/068; A63B 21/072–21/0783; A63B 23/0405; A63B 21/018; A63B 21/40; A63B 21/4007; A63B 21/4005; A63B 23/02; A01K 15/02; A01K 15/027; A01K 27/002; B68B 3/02

USPC ..... 482/92–93, 105–106, 131, 51, 114, 482/148; 119/770, 792, 857; 54/3, 77

See application file for complete search history.

(56) References Cited

U.S. PATENT DOCUMENTS 3,256,015 A * 6/1966 Perrin ..... A63B 21/04 24/129 C 3,751,031 A * 8/1973 Yamauchi ..... A63B 21/065 273/DIG. 19

(Continued)

OTHER PUBLICATIONS

Bas Uterwijk. "Untitled". flickr.com.*

(Continued)

*Primary Examiner* — Oren Ginsberg
*Assistant Examiner* — Garrett Atkinson
(74) *Attorney, Agent, or Firm* — Vedder Price PC

(57) ABSTRACT

A multifunctional exercise apparatus includes a tether removeably affixed to a user and has at least two engagement points. The apparatus includes a base removeably affixed to the tether by at least one engagement point. A triangle is formed when the tether is affixed to the base at a first engagement point and at a second engagement point. The triangle has a first side of the triangle extending between the first engagement point and the second engagement point, a second side of the triangle extends away from the base at an angle from the first engagement point, and a third side of the triangle extends away from the base at a second angle from the second engagement point. A ratio of a length of the second side to a length of the third side varies is substantially proportional to a dragging resistance of the base along the ground.

16 Claims, 2 Drawing Sheets

(51) Int. Cl.
*A63B 21/072* (2006.01)
*A63B 69/00* (2006.01)

(56) References Cited

U.S. PATENT DOCUMENTS

| | | | | | |
|---|---|---|---|---|---|
| 3,953,024 | A * | 4/1976 | Brubacher | B63H 1/38 | 440/100 |
| 3,972,238 | A * | 8/1976 | Thatcher | A61B 5/224 | 434/251 |
| 4,618,142 | A * | 10/1986 | Joseph, Jr. | A63B 5/20 | 482/106 |
| 5,417,635 | A * | 5/1995 | Sell | A63B 21/065 | 482/105 |
| 5,531,657 | A * | 7/1996 | Macedo | A63B 21/0084 | 482/106 |
| 5,630,777 | A | 5/1997 | Garren | | |
| 5,653,665 | A * | 8/1997 | Neeley | A63B 21/0552 | 482/106 |
| 6,497,641 | B1 | 12/2002 | Hinds | | |
| 6,612,971 | B1 * | 9/2003 | Morris | A63B 23/047 | 473/441 |
| D505,459 | S * | 5/2005 | Lagattuta | D21/680 | |
| 6,942,585 | B1 * | 9/2005 | Krause | A63B 69/002 | 473/441 |
| 7,322,905 | B2 * | 1/2008 | Morris | A63B 69/345 | 482/118 |
| D579,990 | S * | 11/2008 | Dalcourt | D21/662 | |
| 7,585,260 | B2 | 9/2009 | Ma | | |
| 7,641,604 | B2 | 1/2010 | Blount | | |
| 8,109,863 | B2 * | 2/2012 | Gilberti | A63B 21/0603 | 473/438 |
| 8,231,511 | B2 * | 7/2012 | Dalcourt | A63B 21/0607 | 482/106 |
| 8,360,938 | B2 * | 1/2013 | Gilman | A63B 21/0615 | 482/51 |
| 8,651,972 | B2 * | 2/2014 | Hoeschler | A63B 67/007 | 446/153 |
| 2003/0224914 | A1 * | 12/2003 | De Montesquieux | A63B 21/0552 | 482/148 |
| 2004/0002408 | A1 * | 1/2004 | Rigas | A63B 5/20 | 482/82 |
| 2006/0116256 | A1 * | 6/2006 | Carney | A63B 21/0724 | 482/106 |
| 2006/0264300 | A1 * | 11/2006 | Chen | A63B 21/072 | 482/14 |
| 2006/0281608 | A1 | 12/2006 | Tuminello | | |
| 2007/0287609 | A1 * | 12/2007 | McBride | A63B 21/4009 | 482/105 |
| 2013/0095984 | A1 * | 4/2013 | Agate | A63B 21/0613 | 482/106 |
| 2013/0130814 | A1 * | 5/2013 | Hoeschler | A63B 67/007 | 472/127 |
| 2014/0145407 | A1 * | 5/2014 | Chen | B62B 1/22 | 280/47.12 |
| 2015/0126344 | A1 * | 5/2015 | Wehrell | A63B 21/0442 | 482/128 |

OTHER PUBLICATIONS

Pat Wolfe. "Workshops." <http://web.archive.org/web/20090515164435/http://www.patwolfefjords.com/WORKSHOPS> May 9, 2009.*

Bas Uterwijk, Untitled Photograph, photo was taken on Aug. 6, 2009.

* cited by examiner

Fig. 1
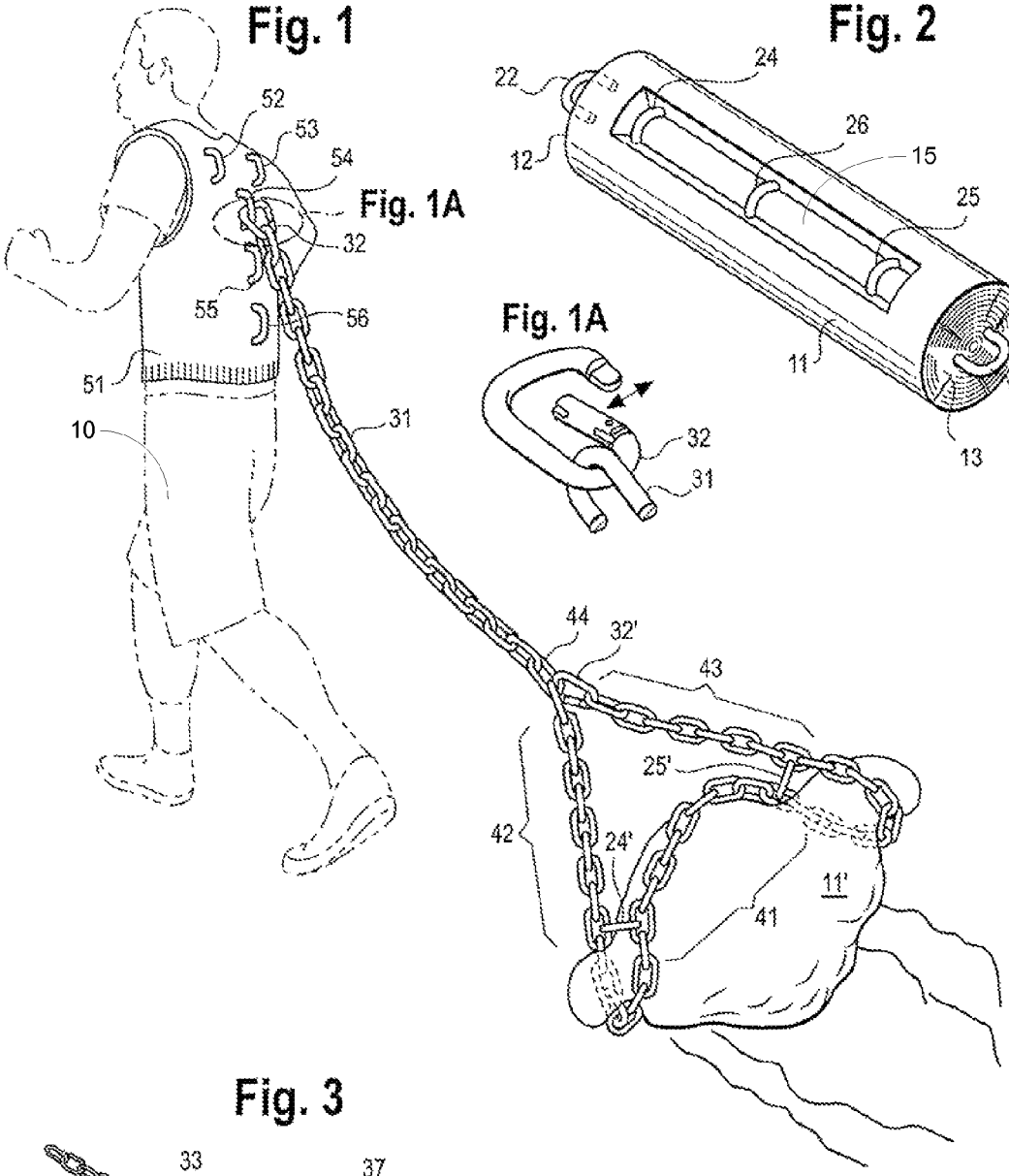
Fig. 2
Fig. 1A
Fig. 3
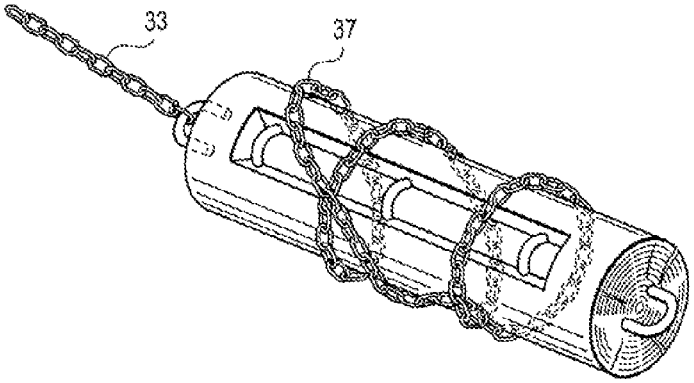

MULTIFUNCTIONAL EXERCISE APPARATUS

CROSS-REFERENCE TO RELATED APPLICATIONS

This is a nonprovisional application claiming the benefit of priority of the provisional application Ser. No. 61/608,633, filed on Mar. 8, 2012, entitled "Heavy Tether Modulated Multiple User-Choice Configuration Exercise Device," in which the entire disclosure is incorporated by reference in its entirety herein.

BACKGROUND OF THE INVENTION

The present invention is directed to a multifunctional exercise apparatus. More particularly, the present invention pertains to an exercise apparatus that includes a base and a heavy tether with a plurality of engagements that engage the base to form multiple configurations.

Presently, there is a significant emphasis on resistance training, weight training, and cardio training for the purposes of developing muscle tone, improving strength, improving balance, and overall fitness. Currently, these results are achieved through independent exercises using a variety of resistance bands, free weights, spring and pulley devices, and a variety of isometric exercises.

In many instances these exercise devices are cumbersome and large or some devices require a series of pulleys and cables to provide variable resistance and not readily portable. In many instances the exercises target and train discrete muscle groups requiring many exercises to train the human body as a whole, increasing time spent exercising and often neglecting other regions of the body. Accordingly, there is a need for a readily transportable exercise apparatus that can be configured in multiple configurations and used to engage multiple muscle groups at once.

BRIEF SUMMARY OF THE INVENTION

A multifunctional exercise apparatus that is readily transportable can be configured in multiple configurations that is used to engage multiple muscle groups at once.

In a preferred embodiment the tether is a multi-part tether and the base is log-shaped with at least two engagement points located on along the surface of the base. The base is formed of a resilient material and the tether has a weight.

These and other features and advantages of the present invention will be apparent from the following detailed description, in conjunction with the appended claims.

In one embodiment, a multifunctional exercise apparatus includes a tether removeably affixed to a user, and the tether has at least two engagement points. The apparatus also includes a base removeably affixed to the tether by at least one engagement point. In addition, a triangle is formed when the tether is affixed to the base at a first engagement point and at a second engagement point. The triangle has a first side of the triangle extending between the first engagement point and the second engagement point, a second side of the triangle extends away from the base at an angle from the first engagement point, and a third side of the triangle extends away from the base at a second angle from the second engagement point. Further, where a ratio of a length of the second side to a length of the third side varies substantially proportional to a dragging resistance of the base along the ground.

In another embodiment, a multifunctional exercise apparatus includes a tether removeably affixed with a user and having a weight of at least 0.5 pounds per foot of tether. The tether has at least one engagement point. The apparatus further includes a base having a weight and including at least a first engagement point, a second engagement point, and a third engagement point. The first engagement point and the second engagement point are displaced along the base, and the third engagement point is positioned medial the first and second engagement points. The at least one tether point of the tether and two of the first engagement point, the second engagement point and the third engagement point form a triangle. A dragging resistance of the base varies as a function of the size of the triangle when a force is exerted on the tether along a plane non-parallel to the base.

BRIEF DESCRIPTION OF THE DRAWINGS

The benefits and advantages of the present invention will become more readily apparent to those of ordinary skill in the relevant art after reviewing the following detailed description and accompanying drawings, wherein:

FIG. 1 is a perspective view of a multifunctional exercise apparatus according to one embodiment of the invention.

FIG. 1A is a perspective view of a connection for a multifunctional exercise apparatus according to one embodiment of the invention.

FIG. 2 is a perspective view of a base of a multifunctional exercise apparatus according to an embodiment of the invention.

FIGS. 3-6 are perspective views of one or more configurations of a multifunctional exercise apparatus according to one embodiment of the invention.

DETAILED DESCRIPTION OF THE INVENTION

Figure 4:
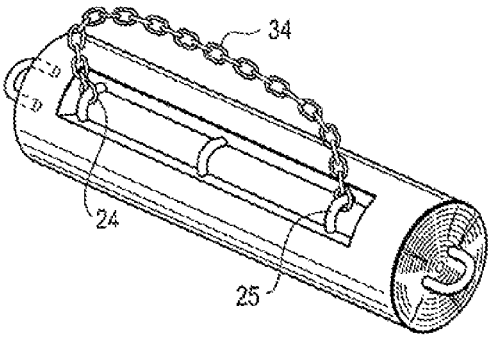

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention" relates to a requirement of the United States Patent Office, and does not imply, not should be inferred to limit the subject matter disclosed herein.

In the present form, this disclosure provides a multifunctional exercise apparatus that allows a user to utilize a weighted tether to vary the pulling resistance during a pulling exercise as well as allowing the base and tether to be easily converted into a lifting device.

The use of a weighted tether reduces the spikes in acceleration resulting from the base being dragged along the ground. As a user drags the base, the base will encounter variations in the ground. These variations will result in the base experiencing spikes in acceleration by applying a force in the opposite direction of motion. This opposite force lengthens the tether. As the base passes over the variation in the surface, the force is no longer applied in the opposite direction of motion, and the tether recoils. The use of a weighted tether prevents the recoil, and prevents a loss of drag resistance and possibly injury to the user. Although any weight tether would modulate abrupt changes to some degree, it was discovered that a tether weighing at least 0.5 pounds per foot makes this modulation sufficient to be effective and noticeable by the user.

Referring to the figures and briefly to FIG. 1, an illustration of a perspective view of a multifunction exercise apparatus according to one embodiment of the invention. As depicted in FIG. 1, the multifunctional exercise apparatus includes a tether 31 and a base 11. In one embodiment, the apparatus may be dragged by a user 10 as depicted in FIG. 1. As such, the weight of the tether 31 and the base 11 results a drag resistance to the user 10. The multifunctional exercise apparatus may be used by the user 10, who is wearing an optional harness 51. In one example, the harness 51 has a series of engagement points 54, 55, and 56 along a vertical axis. The harness 51 has additional engagement points 52 and 53 along a transverse axis. The multiple engagement points along and across the harness allows for the user 10 to choose whether the tether engages a left-of-spine position, a right-of-spine position, or engages at various distances along the user's torso. Changing the location at which the tether connects to the user 10 strengthens discrete muscle groups during the pulling exercise.

The tether 31 may be affixed or connected to the harness 51 at the engagement points 52, 53, 54, 55, and 56 via a connector 32 (FIG. 1A). As depicted, the connector 32 may be a carabineer, however the connector 32 may be via any variety of clasps, latches, ties, or devices capable of securing two structures together.

The tether 31 extends away from the user 10. It is contemplated that the tether 31 may be a single part or multi part tether. As depicted in FIGS. 1-6, the tether 31 includes a chain-like structure with separate links coupled to each other. The tether 31 is shown to be a chain which is a very good example of a weighted tether having a plurality of engagement points. The tether 31, however, need not be a chain. The tether 31 may have any form which provides the user 10 a choice of multiple configurations via a plurality of engagement points along the length of the tether 31 for securing the tether 31 at the base.

As depicted in FIG. 1, the tether 31 extends away from the user 10 and may be separated into two sections 42 and 43. Section 42 of the tether 31 engages the base 11' or 11 at an engagement point 24'. Section 43 of the tether 31 engages the base 25' at a second engagement point, forming a triangle with section 42 being the first side of the triangle and section 43 being the second side of the triangle. The second engagement point 25' being separated from the first engagement point 24' by a distance 41 to sufficiently control the ends of the base 11' when in use. When the triangle is formed the ratio of the length of 42 to the length of 43 is substantially proportional to the dragging resistance of the base along the ground. In a maximum resistance pulling configuration the ratio of 42 to 43 remains substantially equal to each other. The resistance can be lessened by altering the length in either 42 or 43, thereby changing the ratio between 42 and 43. In a minimum resistance pulling configuration, as depicted by FIG. 3, the tether 31 is engaged to an end of the base 11. In another embodiment, a dragging resistance of the base varies as a function of the size of the triangle when a force is exerted on the tether along a plane non-parallel to the base.

Referring now to FIG. 2, there is shown an alternate embodiment of the base 11. This embodiment includes a channel 15 to a top side of the base 11. There are three engagement points 24, 25, 26 disposed within the channel 15 and extending outwardly from the base of the channel 15. Engagement point 26 being medial the first engagement point 24 and the second engagement point 25. In this embodiment, the base 11 is cylindrical in shape and is made of a resilient material. In one embodiment, the base 11 may have an exterior shape resembling a log. The base 11 has two ends 12, 13. The base 11 has a fourth engagement point 22 and a fifth engagement point 23. It is further contemplated that the ends 12 and 13 may be dovetailed or conical in shape. The base 11 need not have this form, as suggested in FIG. 1. The base 11 may have any form which has the functions described and claimed below.

Referring now to FIG. 3, there is shown an alternate embodiment of the exercise apparatus which depicts a multi-part tether structure including a first tether component 33 and a second tether component 37 independent of the first tether component 33. The multi-part tether structure may be used to vary the weight of the base during use. In a further embodiment, the second tether component 37 may further include weights added thereon. The multi-part tether need not have two parts, as suggested by FIG. 3. The multi-part tether may have more than two parts.

In one embodiment, a lifting configuration, as depicted in FIG. 4 may be achieved by connecting the tether at a first engagement point 24 and at a second engagement point 25. This results in a handle spanning a substantial length of the base.

Figure 5:
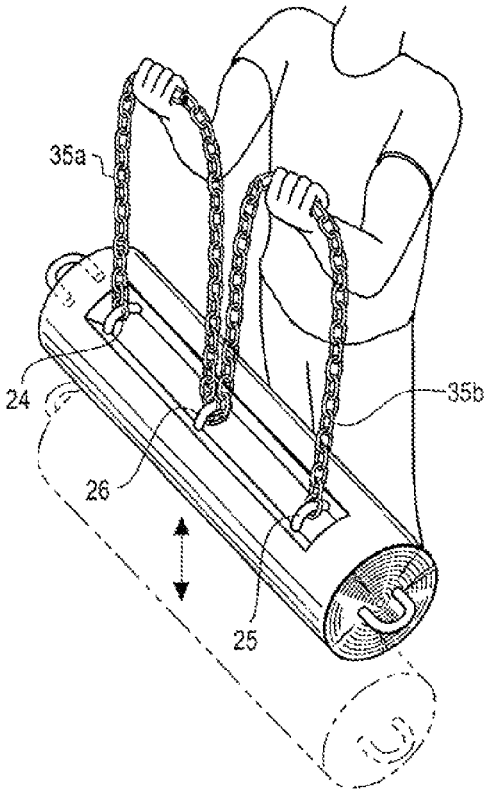

As illustrated by FIG. 5 a further lifting configuration may be achieved when the tether 31 is connected or removably affixed at a first engagement point 24 and connected or removably affixed at a second engagement point 25 and connected at a medial point 26. In this lifting configuration the user 10 may vary the length of the loops to accommodate either upper body exercises or lower body workouts. The length of the tether that is used to form loops 35*a* and 35*b*. Varying the length of the tether 31 can vary the size of the openings 35*a* and 35*b* and either increase or decrease the stability of the base 11 when in use. Varying the stability of the base will result in the user 10 experiencing uneven weight distribution across the user's body, thereby increasing the challenge to your core and stability muscles, making those muscles work harder to keep you balanced.

Figure 6:
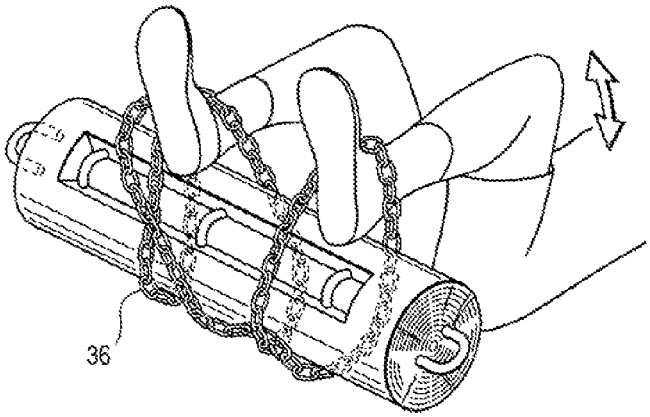

In a further embodiment, FIG. 6 depicts a fourth configuration using the tether 36 and the base 11 of the multifunctional exercise apparatus. According to FIG. 6, the tether 36 is looped around the base 11, without coupled to any engagement points on the base 11.

In the present disclosure, the words "a" or "an" are to be taken to include both the singular and the plural. Conversely, any reference to plural items shall, where appropriate, include the singular.

From the foregoing it will be observed that numerous, configurations, modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A multifunctional exercise apparatus comprising:

a harness configured for a user, having a front and back section, each section being configured to extend from an upper portion disposed at the top of the user's shoulders to a lower portion disposed below the user's torso; the back section of the harness further comprising a first plurality of engagement points positioned along a longitudinal axis located in the top portion of the harness and a second plurality of engagements points located along a vertical axis running the length of the harness at a central portion disposed between the upper and lower portions of the harness back section;

a tether comprising a first end and a second end, said first end being removeably affixed to one of the plurality of engagement points located on the harness;

a base comprising a first fixed engagement point and a second fixed engagement point; wherein the second end of the tether engages with the first fixed engagement point, the second fixed engagement point, and an anchor point to form a triangle, said anchor point being disposed on the tether between the first engagement point and at one of the engagement points located on the harness;

wherein the triangle formed by the tether includes a first side of the triangle extending between the first fixed engagement point and the second fixed engagement point, a second side of the triangle extending between the first fixed engagement point and the anchor point, and a third side of the triangle extending between the second fixed engagement point and the anchor point;

wherein lengths of the first side, the second side, and the third side of the triangle formed by the tether create a dynamic ratio in response to a variable location of the anchor point on the tether; and wherein the base generates a variable dragging resistance on the user as a function of the dynamic ratio of the triangle and a force exerted on the first fixed engagement point and the second fixed engagement point through the tether in moving the base along a plane.

2. The multifunctional exercise apparatus according to claim 1, wherein the length of the tether is sufficient to exert a predetermined amount of tension along the length of the tether.

3. The multifunctional exercise apparatus according to claim 1, wherein the first fixed engagement point further comprises a first connector, and wherein the second fixed engagement point further comprises a second connector.

4. The multifunctional exercise apparatus according to claim 1, wherein the tether further comprises a multi-part-tether.

5. The multifunctional exercise apparatus according to claim 1, wherein the base further comprises tapered ends.

6. The multifunctional exercise apparatus according to claim 1, wherein the first end of the tether comprises a first coupler, and wherein the second end of the tether comprises a second coupler, said second coupler connecting to the tether.

7. The multifunctional exercise apparatus according to claim 1, wherein the base further comprises an elongated shape and is a resilient material.

8. The multifunctional exercise apparatus according to claim 1, wherein the second end further comprises a forked end.

9. An apparatus comprising:

a harness having a back section and being configured for a user, including a plurality of engagement points located on the back section, a tether comprising a first end and a second end, said first end being removeably affixed to any of the plurality of engagement points located on the back section of the harness, said tether having sufficient length to exert a predetermined amount of tension along the length of the tether;

a base comprising a first fixed engagement point and a second fixed engagement point; wherein the second end of the tether engages with the first fixed engagement point, the second fixed engagement point, and an anchor point to form a triangle, said anchor point being disposed on the tether between the first engagement point and at any engagement point located on the harness;

wherein the triangle formed by the tether includes a first side of the triangle extending between the first fixed engagement point and the second fixed engagement point, a second side of the triangle extending between the first fixed engagement point and the anchor point, and a third side of the triangle extending between the second fixed engagement point and the anchor point;

wherein lengths of the first side, the second side, and the third side of the triangle formed by the tether create a dynamic ratio in response to a variable location of the anchor point on the tether; and wherein the base generates a variable dragging resistance on the user as a function of the dynamic ratio of the triangle and a force exerted on the first fixed engagement point and the second fixed engagement point through the tether in moving the base along a plane.

10. The apparatus according to claim 9, wherein the tether is a sufficient length providing for a separation between a back side of the user and the base to enable exertion of the desired amount of tension of the tether.

11. The apparatus according to claim 9, wherein the first fixed engagement point comprises a first connector, and wherein the second fixed engagement point comprises a second connector.

12. The apparatus according to claim 9, the base further comprising a first end and a second end, said first end having a first end fixed engagement point, and said second end having a second end fixed engagement point.

13. The apparatus according to claim 9, wherein the base further comprises tapered ends.

14. The apparatus according to claim 9, wherein the base further comprises an elongated shape and is a resilient material.

15. The apparatus according to claim 9, wherein the first end of the tether further comprises a first coupler, and wherein the second end of the tether further comprises a second coupler, said second coupler connecting to the tether.

16. The apparatus according to claim 9, wherein the second end further comprises a forked end.

* * * * *